US005952987A

United States Patent [19]

Browning et al.

[11] Patent Number: 5,952,987

[45] Date of Patent: Sep. 14, 1999

[54] METHOD AND APPARATUS FOR IMPROVED GRAY SCALE CONTROL IN FIELD EMISSION DISPLAYS

[75] Inventors: Jim J. Browning; Dean A. Wilkinson, both of Boise, Id.

[73] Assignee: Micron Technology, Inc., Boise, Id.

[21] Appl. No.: 08/599,441

[22] Filed: Jan. 18, 1996

[51] Int. Cl.[6] ..... G09G 3/22

[52] U.S. Cl. ..... 345/74; 345/208

[58] Field of Search ..... 345/74, 75, 89, 345/208, 209, 210; 315/169.1, 169.3, 167; 313/497

[56] References Cited

U.S. PATENT DOCUMENTS

| | | | |
|---|---|---|---|
| 4,940,916 | 7/1990 | Borel et al. | 313/306 |
| 5,126,865 | 6/1992 | Sarma | 345/149 |
| 5,151,632 | 9/1992 | Troxell | 345/75 |
| 5,157,524 | 10/1992 | Dijon et al. | 345/89 |
| 5,194,780 | 3/1993 | Meyer | 315/169.3 |
| 5,283,500 | 2/1994 | Kochanski | 315/169.3 |
| 5,357,172 | 10/1994 | Lee et al. | 315/167 |
| 5,387,844 | 2/1995 | Browning | 315/169.3 |
| 5,404,081 | 4/1995 | Kane et al. | 315/169.1 |
| 5,514,937 | 5/1996 | Kane et al. | 315/169.1 |
| 5,536,993 | 7/1996 | Taylor et al. | 315/169.3 |
| 5,574,333 | 11/1996 | Clerc | 313/497 |
| 5,578,906 | 11/1996 | Smith | 315/169.3 |
| 5,592,056 | 1/1997 | Peyre et al. | 315/169.3 |

OTHER PUBLICATIONS

Itoh, et al., "A New Structure of Field Emitter Arrays," J. Vac. Sci. Tech. B 14(3),pp. 1977–1981 (Received Aug. 1995, Published May/Jun. 1996).

D. Cathey, Jr., "Field Emission Displays", Micron Display Technology, Boise, ID.

J.D. Levine, "Benefits of the Lateral Resistor in a FED", IVMC, 1995, Portland OR, pp. 67–71.

J.D. Levine et al., "Field Emission from Microtip Test Arrays Using Resistor Stabilization", IVMC '94, Grenoble, France.

J.D. Levine, "Statistical Analysis of Field Emitter Emissivity . . . ", Revue, "Le Vide, Les Couches Minces", Supp. No. 271, Mar.–Apr. 1994, pp. 73–75.

*Primary Examiner*—Steven J. Saras
*Assistant Examiner*—John Suraci
*Attorney, Agent, or Firm*—Hale and Dorr LLP

[57] ABSTRACT

According to the invention, a process is provided for controlling illumination of a pixel in a field emission display. In one embodiment, the process includes the steps of providing a first voltage to the first tip array, providing a second voltage to the second tip array in which the second voltage is different than the first voltage. In another embodiment of the invention, a field emission display is provided which has a plurality of pixels, each pixel having at least a first tip array and a second tip array, a column conductor, or electrode, an electrical communication with the first tip array.

20 Claims, 5 Drawing Sheets

METHOD AND APPARATUS FOR IMPROVED GRAY SCALE CONTROL IN FIELD EMISSION DISPLAYS

GOVERMENT RIGHTS

This invention was made with Government support under Contract No. DABT63-93-C0025 awarded by Advanced Research Projects Agency (ARPA). The Goveirment has certain rights in this invention.

BACKGROUND OF THE INVENTION

This invention relates to the art of field emission displays (FED) and, more specifically, to a process and apparatus for improved grey-scale control in FED devices.

FIG. 1 is a cross-sectional view of a typical field-emission display. As seen, the FED comprises a faceplate 16, with a luminescent phosphor coating placed thereon, separated from a backplate, or substrate 11. On the backplate 11, there is formed a plurality of emitters 13 which are electrically connected at the base to a column electrode 12. Near the tip of the emitters there is provided an extraction grid 15. In order to generate a display on the faceplate 16, a voltage differential 20 is provided between the extraction grid 15 and the column electrode 12. This causes electron emission, often referred to "Fowler-Nordheim" emission, from the emitter tips. The electrons 17 are drawn to the faceplate 16 by electrostatic attraction, where they strike the phosphor coating causing illumination of the faceplate 16. In practice, the substrate of the FED is subdivided into a plurality of independently addressable pixels 22, each pixel having an array of emitters for causing illumination. A more detailed description of general FED technology is found in "Field-Emission Displays" by David A. Cathey, Jr., incorporated herein by reference.

One problem encountered in the manufacture of FED's is that a linear increase in the extraction grid voltage results in an exponential increase for the emitter current. This makes control of the illumination level of a given pixel difficult, and increases the odds of an undesirable effect, such as a pixel failure. In order to prevent these undesirable effects, a resistor or resistive layer is often formed between the emitter tips and the emitter conductor, as described in U.S. Pat. No. 4,940,916 to Borel, and U.S. Pat. No. 4,387,844 to Browning, both incorporated herein by reference.

With a current limiting resistor in series with the emitter tip, the current increases initially as a power function, described by the FN equation; but as the current becomes large enough, the linear current/voltage characteristics of the resistor begins to dominate, and the current increase becomes approximately linear for linear increases in grid voltage. With a large current limiting resistor, for example, one or more gigaohms, the resistor can stabilize the tip emission even at very low current levels, for example, in the nanoamp range. This occurs because excursions in the emitter current are limited by the resistor generated voltage drop, so as the current increases, the tip to grid voltage decreases and emission then decreases. This provides good control of low luminance grey levels. However, the large resistance also requires a large excursion of the grid voltage in order to achieve high luminance levels which require larger currents.

With a relatively small current limiting resistor, for example, 100 megohm, higher luminance level currents can be achieved with a much smaller range of grid voltages, but the low gray levels receive very little stabilization benefit; hence, the power function dominates the emission. This is because the voltage drop across the low value resistor causes insignificant changes in the tip to grid voltage during current excursions. For example, a 1 nanoamp current would cause a 1 volt drop across a 1 gigaohm resistor but only a 0.1 volt drop across a 100 megohm resistor. While a one volt drop is significant, a 0.1 volt drop would have little effect.

In a passive matrix FED, the display pixel is typically addressed by row and column lines, or electrodes. The column lines are typically used for gray scale control. The column line is electrically connected to the emitter tips of a pixel by a resistor. This resistor may be a film or layer having the desired resistivity. This layer provides the current limiting resistance for stabilizing the emission.

The row line of the display is connected to the emitter grid. Therefore, a display pixel is addressed by driving the grid (row) positive with respect to the ground, and by driving the emitter tip (column) negative. Alternately, the tip is biased positively normally, and then pulled toward ground to address the pixel. This is the scheme that will be used herein for purposes of illustration. However, those with skill in the art will recognize that other addressing schemes could be used.

In a passive matrix FED, it is desirable to reduce the required grid voltage range to conserve power in the drive circuitry. But, it is a also important to maintain stable emissions at low luminance gray levels to avoid problems with flickering tips, tip-to-tip, non-uniformities and luminance variations across the display. Therefore, there is a need in the art for an apparatus which will overcome the above mentioned difficulties.

SUMMARY OF THE INVENTION

According to the invention, a process is provided for controlling illumination of a pixel in a field emission display having multiple tip arrays. In one embodiment, the process comprises providing a first voltage to the first tip array, providing a second voltage to the second tip array, the second voltage being different than the first voltage. In another embodiment of the invention, an FED is provided having a plurality of pixels, each pixel having at least a first tip array and a second tip array, a column conductor in electrical communication with the first tip array, and a voltage biasing circuit which provides electrical communication between the column conductor and the second tip array.

In still a further embodiment, there is provided a field emission display having a faceplate, a substrate and an extraction grid, the field emission display comprising a plurality of pixels, each pixel having at least a first tip array and a second tip array, a column conductor in electrical communication with the first tip array, and a voltage biasing circuit which provides electrical communication between the column conductor and the second tip array.

In yet a further embodiment, there is provided a field emission display comprising a ground electrode, a column electrode, a plurality of pixels, each pixel having a first tip array and at least a second tip array, the first tip array being formed on a first resistive layer, the first resistive layer having a first column electrode connector and a first ground electrode connector, the second tip array being formed on a second resistive layer, the second resistive layer being connected to a voltage biasing circuit which is in electrical communication with the ground electrode and the column electrode.

BRIEF DESCRIPTION OF THE EMBODIMENTS OF THE INVENTION

For a more complete understanding of the invention and for further advantages thereof, reference is made to the following detailed description taken in conjunction with the accompanying drawings, in which.

Figure 1:
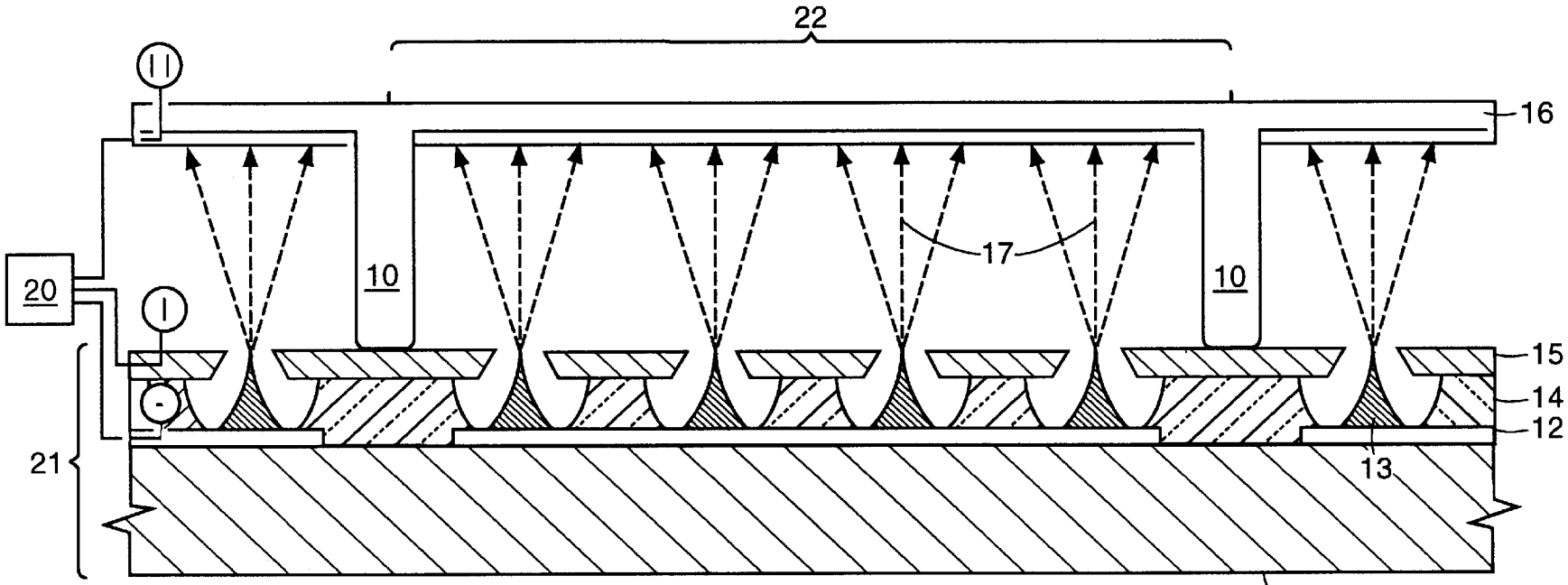
FIG. 1 is a cross section review of a typical field emission display.
Figure 2:
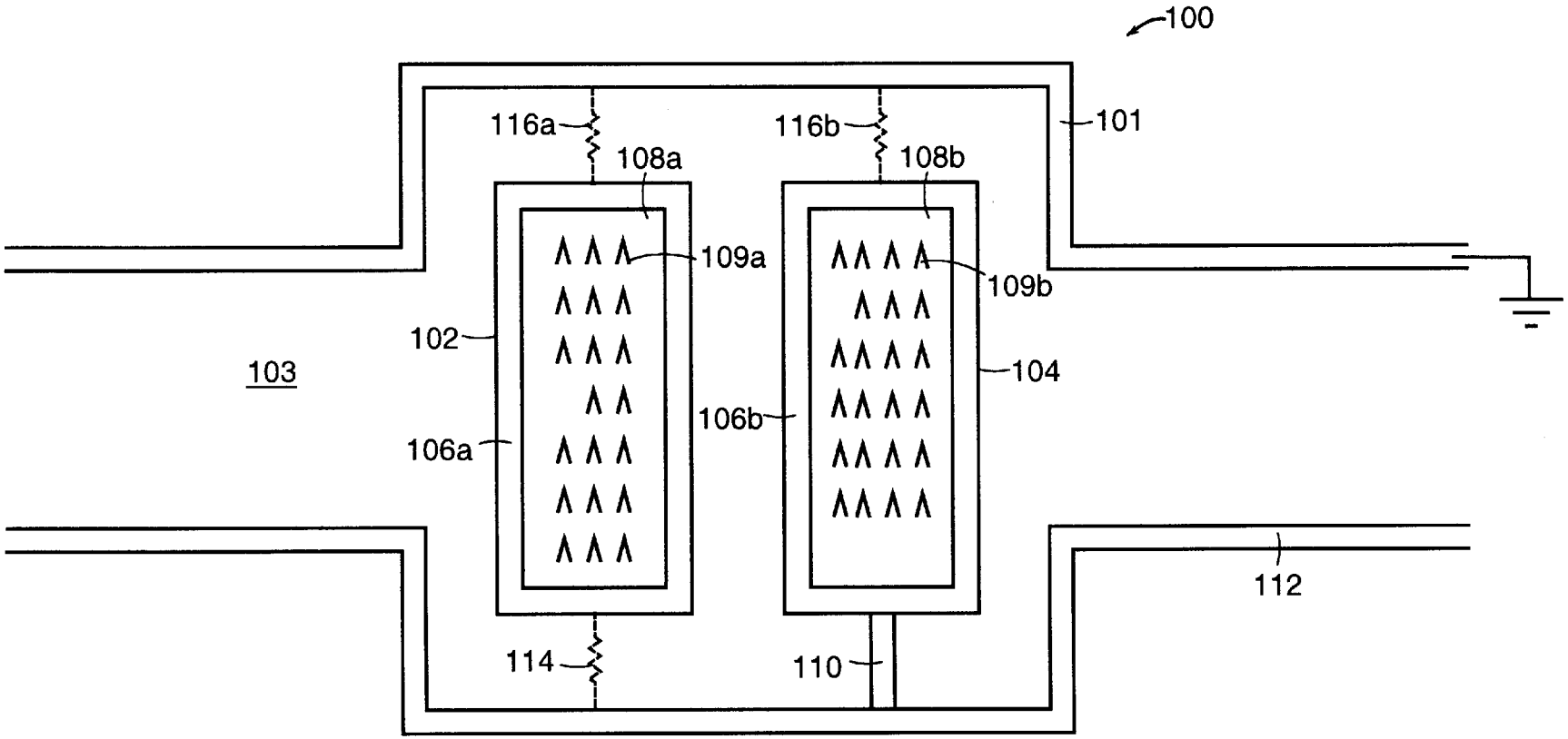
FIG. 2 is a diagram of a device according to one embodiment of the invention.
Figure 3:
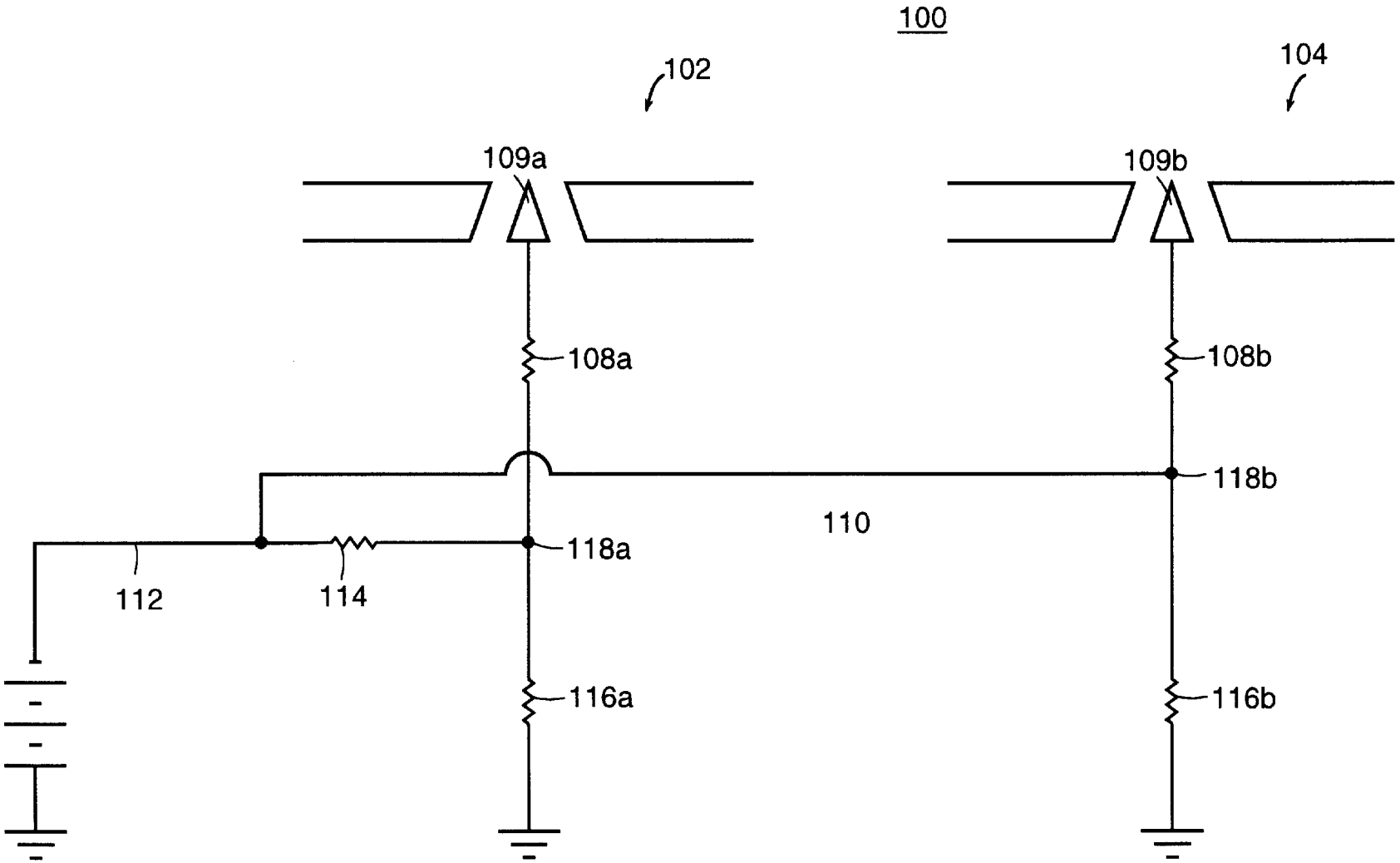

FIG. 3 and its schematic diagram of the embodiment of the invention shown FIG. 2.

Figure 4:
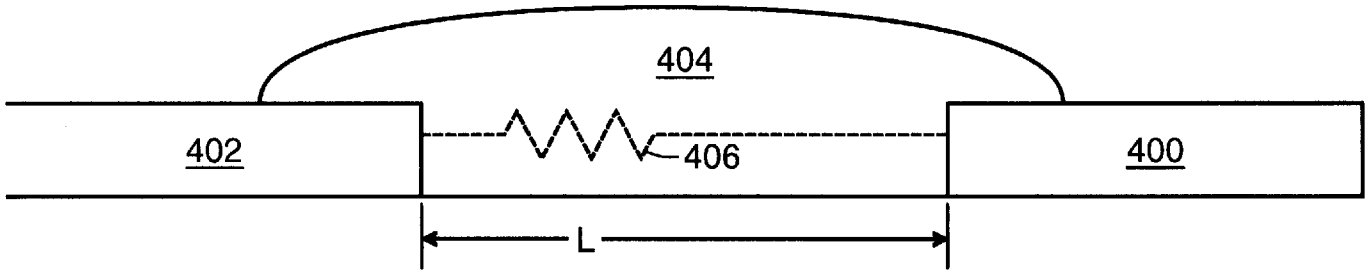

FIG. 4 is a cross sectional view of a device illustrating one type of lateral resistor.

Figure 5:
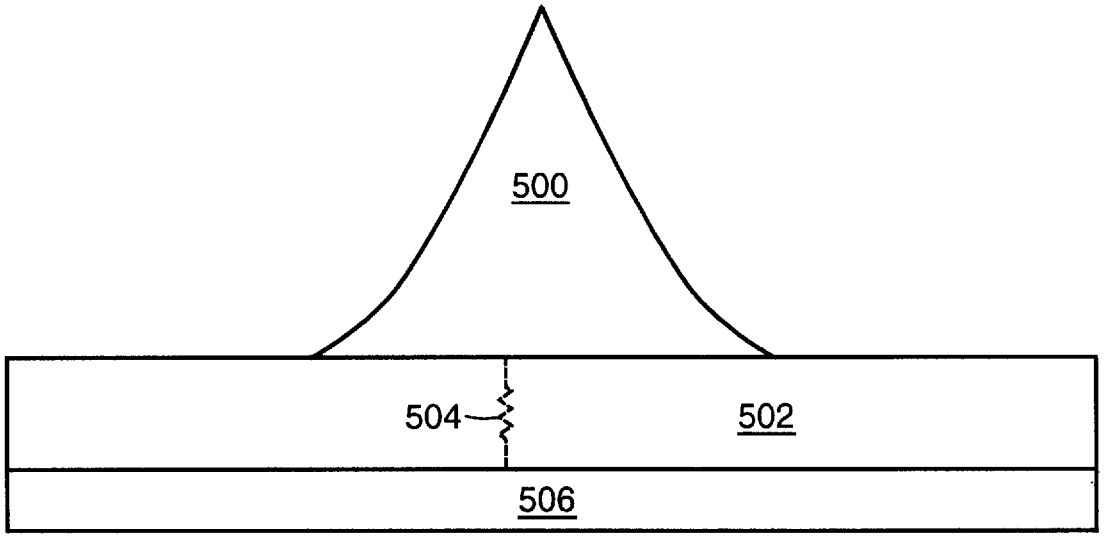

FIG. 5 is a cross sectional view of a emitter tip of a field emission display illustrating use of a vertical resistor.

Figure 6:
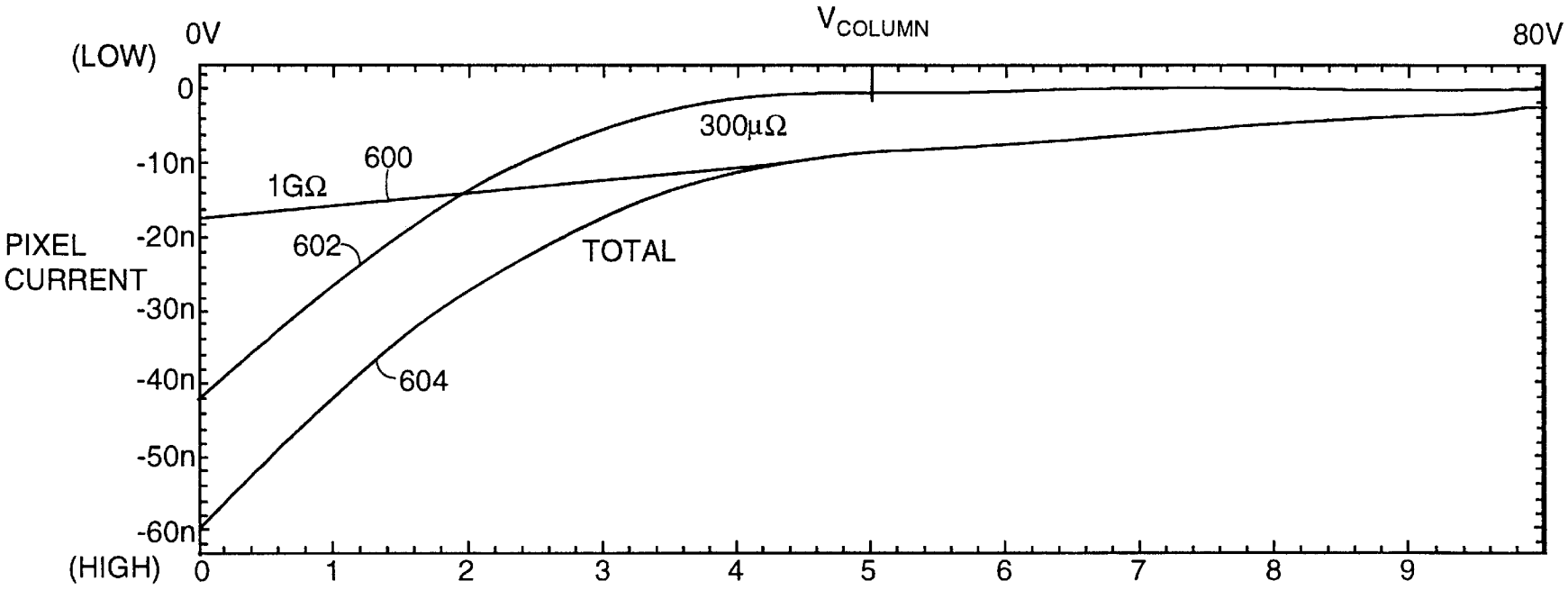

FIG. 6 is a graph illustrating the emission current in an embodiment of the invention having a 1 gigaohm resistance in the first tip array and a 300 megohm resistance in a second tip array.

It is to be noted, however, that the appended drawings illustrate only typical embodiments of this invention and are therefore not to be considered limiting of its scope, for the invention may admit to other equally effective embodiments.

DETAILED DESCRIPTION OF EMBODIMENTS OF THE INVENTION

Referring now to FIG. 2, there is shown an example embodiment of the invention. In this embodiment, the field emission display comprises a plurality of pixels, only one pixel 100 being shown here for purposes of illustration, wherein each pixel 100 has at least a first tip array 102 and a second tip array 104. As shown, each tip array 102, 104, is formed on a substrate 103. With respect to tip array 102, it is seen that the array comprises a plurality of emitter tips 109*a* which are formed on top of a resistive layer 108*a*. Resistive layer 108*a* is formed on top of metal layer 106*a* which is in turn formed on a substrate 103. Similarly, tip array 104 comprises plurality of emitter tips 109*b* which are formed on top of a resistive layer 108*b*. Resistive layer 108*b* is disposed on metal layer 106*b* which is, in turn, formed on substrate 103. In this embodiment, the emitter tips formed within pixel 100 are divided into two separate tip arrays. Of course, it is to be understood that in additional embodiments of the invention, the pixel 100 is subdivided into more than two tip arrays. Embodiments having more than two tip arrays allow for even finer control over the gray scale but are more difficult to manufacture. However, for purposes of illustration, it is sufficient to refer to the embodiment with two tip arrays per pixel.

Referring again to FIG. 2, each of the tip arrays are in electrical communication with a ground electrode 101 and a column electrode 112. When a voltage differential is provided between the column electrode 112 and the grid electrode (not shown), the emitters 109*a*, 109*b* of the tip arrays 102, 104 emit electrons which will illuminate the phosphor screen (not shown) as described earlier. However, as shown in the figure, it is seen that conductive layer 106*b* of tip array 104 is connected by a connector, in this case a metal line 110, directly to column electrode 112. Other connectors could also be used, such as polysilicon layers doped to a desired resistivity. By contrast, metal layer 106*a* of tip array 102 is connected to column electrode 112 by lateral resistor 114. Further, both tip arrays 102 and 104 are connected to the ground electrode 101 by lateral resistors 116*a* and 116*b*. It will be appreciated by those of skill in the art that resistor 116*b* could be made practically infinite by providing isolation of tip array 104. These connections form a resistive network which, for a given voltage differential between the column electrode 112 and ground electrode 101, will provide different voltages to the respective tip arrays 102 and 104. This is explained in greater detail with respect to FIG. 3.

FIG. 3 is a schematic diagram of the field emission display shown in FIG. 2. As discussed previously, resistors 108*a* and 108*b* are formed by disposing a resistive layer on top of the metal layers 106*a* and 106*b* respectively. Resistors 114, 116*a* and 116*b* are lateral resistors which are described with respect to FIG. 4. Specifically, as shown in FIG. 4, metal layer 402 is separated from metal layer 400 by resistive layer 404. The valie of resistor 406 depends on the resistivity of the material used to form the resistive layer 404. Therefore, the value of resistor 406 may be controlled during the fabrication of the field emission display by altering the resistivity of the resistive layer 404 by, for example, doping the resistive layer, or using other materials with different resistivities or, by varying the length L separating the conductive elements 402 and 400. A more detailed description of lateral resistors is provided by J. Levine, "Benefits of the Lateral Resistor," IVMC P. 67, 1995, Portland, Oreg., which is incorporated herein by reference.

Resistors 108*a* and 108*b* are vertical resistors (although lateral resistors are also acceptable) and are described in greater detail with respect to FIG. 5. FIG. 5 shows an example of an emitter tip 500 connected to a metal layer 506 by resistive layer 502. Again, resistive layer 502 provides a resistance, illustrated schematically by resistor 504, between the emitter tip 500 and the metal layer 506. The value of resistor 504 may be controlled by varying the resistivity of layer 502 and also by varying the physical parameters of the device, such as the thickness of layers 502 and the size of emitter tip 500.

Referring again to FIG. 3, it is seen that for tip array 104 a voltage level V impressed on column electrode 112 will be provided directly to node 118*b*, and in turn, to emitter tip 109*b* via resistor 108*b*. However, for tip array 102, resistors 114 and 116*a* provide a voltage biasing circuit, in this case, a resistor divider network, which reduces the violtage applied to node 118*a* by dropping some of the column electrode voltage across resistor 114. Therefore, for a single column electrode voltage, the invention permits multiple voltage to be applied to different tip arrays within the same pixel by selecting different values for the resistors.

For example, in one embodiment of the invention, resistor 114 is selected to be about 500 megohms, resistor 108*a* is selected to be about 1 gigaohm, and resistor 108*b* is selected to be about 200 megohms. In this embodiment, as column electrode 112 is pulled low, tip array 102 turns on before tip array 104 because the voltage at node 118*a* is biased closer to ground. Since resistor 108*a* is selected to be a large resistor, the current through emitter 109*a* rises gradually as the voltage on column electrode 112 is pulled down. As column electrode 112 is pulled even lower, tip array 104 turns on. Since resistor 108*b* is selected to be a small resistance, the current through emitter 109*b* rises faster than the current through emitter 109*a*. Therefore, the sum of the currents through tip array 102 and tip array 104 represents the total current which will strike the phosphor of the pixel 100.

Since tip array 102 has a large stabilizing resistance value, the less stable portion of the low resistance curve occurs at a relatively higher gray level. This reduces the percentage variation of the total pixel brightness from unstable emitters. Moreover, since tip array 104 has relatively low resistance

108*b*, the power consumption is reduced in comparison to the power required if only a large resistance was used in all emitters. Therefore, it is seen that this embodiment provides good stability at low luminescent levels and relatively low power consumption.

FIG. 6 is a graph illustrating the emmission current of a device produced according to the embodiment of the invention shown in FIG. 3. Line 600 represents the pixel current versus column voltage curve for tip array 102 in which the value of resistor 108*a* is a one gigaohm. As seen, the high resistance of resistor of 108*a* provides a very linear increase in pixel current as the column voltage is reduced. By contrast, in tip array 104 the pixel current varies according to a power function as the column voltage is reduced. This is seen in line 602 of the Figure. In this case, tip array 104 is provided with a resistor 108*b* having a value of 300 megohms. Of course, the total current impinging on the face plate in pixel 100 is the combination of the currents represented by lines 600 and 602. The total current is shown by line 604. It is seen that this curve is more linear than it would be if only small resistances were used in the tip arrays.

It is to be understood that the above described embodiments are merely illustrative of the invention and that additional embodiments will occur to those who are skilled in the art without departing from the scope and spirit of the present invention.

What is claimed is:

1. A process for controlling illumination of a pixel in a field emission display ("FED"), the pixel having a first tip array and a second tip array, the process comprising:

from a common voltage input, providing a first voltage to the first tip array;

from the common voltage input, providing a second voltage to the second tip array, the second voltage being different than the first voltage such that both the first and second tip arrays may simultaneously emit electrons to illuminate the pixel, but at different rates.

2. A process as in claim 1 wherein providing a first voltage comprises providing a column voltage to the first tip array.

3. A process as in claim 2 wherein providing a second voltage comprises applying the column voltage to a voltage divider network.

4. A field emission display ("FED") comprising:

a plurality of pixels, each pixel having at least a first tip array and a second tip array;

a column conductor in electrical communication with the first tip array so as to provide a first voltage to the first tip array;

a voltage biasing circuit which provides electrical communication between the column conductor and the second tip array and in which the biasing circuit provides a second voltage to the second tip array, the second voltage being different than the first voltage such that both the first and second tip arrays may simultaneously emit electrons to illuminate the pixel, but at different rates.

5. A FED as in claim 4 wherein the voltage biasing circuit comprises a voltage divider circuit which lowers a voltage on the column conductor with respect to a ground voltage level.

6. A field emission display ("FED") comprising:

a plurality of pixels, each pixel having at least a first tip array and a second tip array;

a column conductor in electrical communication with the first tip array so as to provide a first voltage to the first tip array;

a voltage biasing circuit which provides electrical communication between the column conductor and the second tip array and in which the biasing circuit provides a second voltage to the second tip array, the second voltage being different than the first voltage such that both the first and second tip arrays may simultaneously emit electrons to illuminate the pixel, but at different rates wherein the voltage biasing network comprises a voltage divider circuit which lowers a voltage on the column conductor with respect to a ground voltage; and wherein the voltage divider network comprises a first resistor which provides electrical connection between the column conductor and the second tip, array, and a second resistor which provides electrical connection between a ground conductor and the second tip array.

7. A FED as in claim 6 wherein the first resistor is a lateral resistor.

8. A FED as in claim 6 wherein the second resistor is a lateral resistor.

9. A field emission display comprising:

a ground electrode;

a column electrode;

a plurality of pixels, each pixel having a first tip array and at least a second tip array, the first tip array being formed on a first resistive layer, the first resistive layer having a first column electrode connector and a first ground electrode connector, the second tip array being formed on, a second resistive layer, the second resistive layer being connected to a voltage biasing circuit which is in electrical communication with the ground electrode and the column electrode in which the biasing circuit provides a second voltage to the second tip array, the second voltage being different than the first voltage such that both the first, and second tip arrays may simultaneously emit electrons to illuminate the pixel, but at different rates.

10. A field emission display as in claim 9 wherein the first column electrode connector is a metal layer.

11. A field emission display as in claim 9 wherein the first column electrode connector is a polysilicon layer.

12. A field emission display as in claim 9 wherein the first ground electrode connector is a lateral resistor.

13. A field emission display as in claim 9 wherein the voltage biasing circuit comprises a voltage divider circuit.

14. A field emission display comprising:

a ground electrode;

a column electrode;

a plurality of pixels, each pixel having a first tip array and at least a second tip array, the first tip array being formed on a first resistive layer, the first resistive layer having a first column electrode connector and a first ground electrode connector, the second tip array being formed on a second resistive layer, the second resistive layer being connected to a voltage biasing circuit which is in electrical communication with the ground electrode and the column electrode in which the biasing circuit provides a second voltage to the second tip array, the second voltage being different than the first voltage such that both the first and second tip arrays may simultaneously emit electrons to illuminate the pixel, but at different rates;

wherein the voltage biasing circuit comprises a voltage divider circuit; and wherein the voltage divider circuit comprises a first resistive connection between the second resistive layer and the column electrode and a second resistive connection between the second resistive layer and the ground electrode.

15. A field emission display as in claim 14 wherein the first resistive connection and the second resistive connection are lateral resistors.

16. A display circuit, comprising a first and a second emitter arranged to provide electrons to illuminate a pixel;

a biasing rietwork in electrical communication with the first and second emitters and with a voltage input, the network characterized in that, for a given voltage being applied to the voltage input, the network provides a relatively gradual rise of current through the first emitter and a relatively faster rise of current through the second emitter, such that the first and second emitters provide different rates of electrons to illuminate the pixel.

17. The display circuit of claim 16 wherein the biasing network includes a first subnetwork connecting the voltage input to the first emitter and characterized by a first voltage drop between the voltage input and the first emitter; and a second subnetwork connecting the voltage input to the second emitter and characterized by a second voltage drop between the voltage input and the second emitter;

wherein the second voltage drop is substantially smaller than the first voltage drop.

18. A display circuit, comprising a first and a second emitter arranged to provide electrons to illuminate a pixel;

a biasing network in electrical communication with the first and second emitters and with a voltage input, the network characterized in that, for a given voltage being applied to the voltage input, the network provides a relatively gradual rise of current through the first emitter and a relatively faster rise of current through the second emitter, such that the first and second emitter provides different rates of electrons to illuminate the pixel, wherein the biasing network includes a first subnetwork connecting the voltage input to the first emitter and characterized by a first voltage drop between the voltage input and the first emitter; and a second subnetwork connecting the voltage input to the second emitter and characterized by a second voltage drop between the voltage input and the second emitter; and wherein the second voltage drop is substantially smaller than the first voltage drop wherein the ratio of the first voltage drop and the second voltage drop is greater than 5 to 1.

19. A display circuit, comprising a first and a second emitter arranged to provide electrons to illuminate a pixel;

a biasing network in electrical communication with the first and second emitters and with a voltage input, the network characterized in that, for a given voltage being applied to the voltage input, the network provides a relatively gradual rise of current through the first emitter and a relatively faster rise of current through the second emitter, such that the first and second emitters provide different rates of electrons to illuminate the pixel, wherein the biasing network includes a first subnetwork connecting the voltage input to the first emitter and characterized by a first voltage drop between the voltage input and the first emitter; and a second subnetwork connecting the voltage input to the second emitter and characterized by a second voltage drop between the voltage input and the second emitter; wherein the second voltage drop is substantially smaller than the first voltage drops and wherein the first subnetwork produces a substantially linear relationship between a voltage input and emitter current over a voltage range of operation for the first emitter; and wherein the second subnetwork produces a substantially non-linear relationship between a voltage input and emitter current over a voltage range of operation for the second emitter, the non-linear relationship being characterized as a power function relationship.

20. A display circuit, comprising a first and a second emitter arranged to provide electrons to illuminate a pixel;

a biasing network in electrical communication with the first and second emitters and with a voltage input, the network characterized in that, for a given voltage being applied to the voltage input, the network provides a relatively gradual rise of current through the first emitter and a relatively faster rise of current through the second emitter, such that the first and second emitters provide different rates of electrons to illuminate the pixel, wherein the biasing network includes a first subnetwork connecting the voltage input to the first emitter and characterized by a first voltage drop between the voltage input and the first emitter; and a second subnetwork connecting the voltage input to the second emitter and characterized by a second voltage drop between the voltage input and the second emitter; wherein the second voltage drop is substantially smaller than the first voltage drop, and wherein the first and second subnetworks include resistive components only.

* * * * *